US008590072B2

(12) United States Patent
Brunner et al.

(10) Patent No.: US 8,590,072 B2
(45) Date of Patent: Nov. 26, 2013

(54) SANITARY FITTING WITH INSULATED OUTFLOW PIPE

(75) Inventors: Stefan Brunner, Moosleerau (CH); Pascal Henzmann, Reinach (CH)

(73) Assignee: KWC AG, Unterkulm (CH)

( * ) Notice: Subject to any disclaimer, the term of this patent is extended or adjusted under 35 U.S.C. 154(b) by 947 days.

(21) Appl. No.: 12/659,067

(22) Filed: Feb. 24, 2010

(65) Prior Publication Data

US 2010/0213398 A1 Aug. 26, 2010

(30) Foreign Application Priority Data

Feb. 25, 2009 (EP) ..... 09002624

(51) Int. Cl.
*E03C 1/05* (2006.01)

(52) U.S. Cl.
USPC ..... 4/623

(58) Field of Classification Search
USPC ..... 4/619–660
See application file for complete search history.

(56) References Cited

U.S. PATENT DOCUMENTS

| | | | | |
|---|---|---|---|---|
| 2006/0077652 | A1 * | 4/2006 | Theus | 362/96 |
| 2006/0152917 | A1 * | 7/2006 | Stuhlmacher et al. | 362/109 |

FOREIGN PATENT DOCUMENTS

| | | | |
|---|---|---|---|
| DE | 196 81 725 | B4 | 4/2007 |
| DE | 10 2007 015 424 | A1 | 10/2008 |
| DE | 102007015424 | A1 * | 10/2008 |
| EP | 1 739 241 | A1 | 1/2007 |
| EP | 1739241 | A1 * | 1/2007 |
| WO | WO 2004/013966 | A1 | 2/2004 |
| WO | WO 2004/051010 | A2 | 6/2004 |
| WO | WO 2004/081300 | A1 | 9/2004 |

OTHER PUBLICATIONS

European Search Report dated Apr. 8, 2010 with English translation.

* cited by examiner

*Primary Examiner* — Lori Baker
(74) *Attorney, Agent, or Firm* — Oliff & Berridge, PLC

(57) ABSTRACT

The sanitary fitting has an outflow pipe and a mounting base. The outflow pipe is arranged galvanically isolated from the mounting base and serves as the electrode of a sensor device. The sensor device detects whether an object, for example a hand, is present in a sensor zone or not and thereupon generates a presence or an absence signal. An electronic control system controls, in accordance with the presence or absence signal, a valve device, which controls a water flow. The electronic control system can also actuate light sources which illuminate the mounting base and the nozzle region.

10 Claims, 3 Drawing Sheets

SANITARY FITTING WITH INSULATED OUTFLOW PIPE

BACKGROUND

The present invention relates to a sanitary fitting.

A sanitary fitting is known, for example, from document WO 2004/051010 A. The sanitary fitting has an outflow pipe, which is disposed on a mounting base and projects over the mounting base with an outflow pipe section. The sanitary fitting can be fastened by means of the mounting base to a support. In the mounting base or in the outflow pipe, a sensor, for example, an infrared sensor, can be arranged, to detect whether a person is present within the sensor zone or not. The sensor is connected to an electronic control system, which, on the one hand, actuates a light source disposed on the outflow pipe and, on the other hand, actuates a valve, which valve releases or interrupts the water flow through the outflow pipe.

SUMMARY

An object of the disclosed embodiment is to provide a sanitary fitting of a generic type, the outflow pipe of which can serve other purposes.

According to an exemplary embodiment at least one electrically conductive outflow pipe section of an outflow pipe, which section runs outside the mounting base, is galvanically isolated from the mounting base of the sanitary fitting. The possibility is thereby created of using the outflow pipe itself or its outflow pipe section, for example, as part of an electronic circuit, in particular of a sensor.

In a preferred manner, the outflow pipe section, or the outflow pipe, is also galvanically isolated from the specific water which is to flow through this section. This allows the sanitary fitting to be used even in areas with less clean, and thus electrically less well insulating water than in areas with very clean water.

In a particularly preferred embodiment of the sanitary fitting according to the invention, the outflow pipe section itself forms an electrode of a sensor device. In a preferred manner, the electronics of the sensor device is constructed as disclosed in printed publication WO 2004/013966 A.

In a further particularly preferred embodiment, a valve device for controlling the water flow through the outflow pipe is controlled by an electronic control system, which, for its part, is actuated by the sensor electronics. In a preferred manner, the water flow is controlled according to the method known from EP 1 601 841 A.

Further preferred embodiments of the sanitary fitting according to the invention are described in detail below.

DETAILED DESCRIPTION OF EMBODIMENTS

Figure 1:
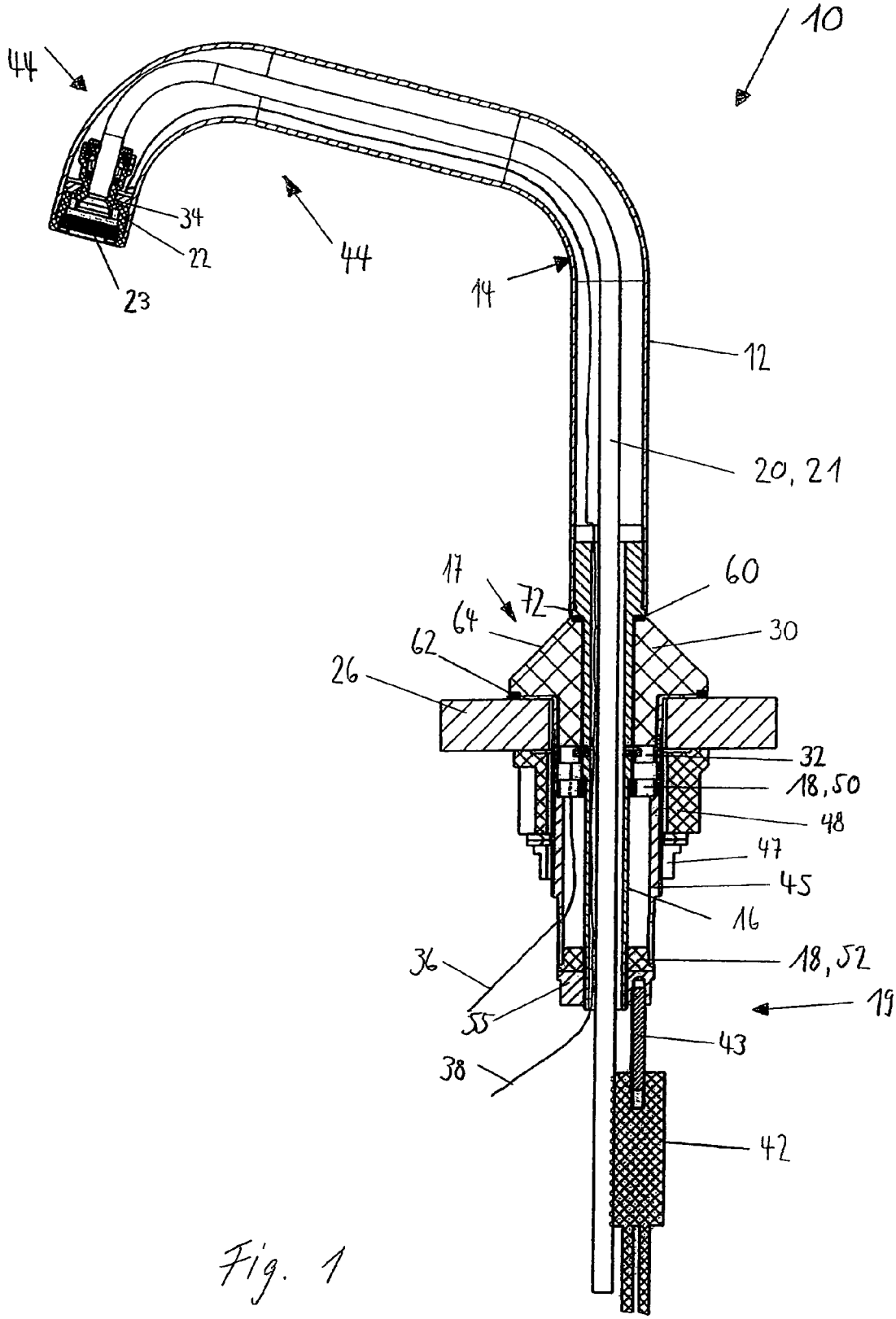
FIG. 1 illustrates a longitudinal section through a sanitary fitting according to this disclosure having an outflow pipe fastened to a support by means of a mounting base, the outflow pipe being galvanically isolated from the mounting base.

FIG. 1 shows a particularly preferred embodiment of a sanitary fitting 10 according to this disclosure having an outflow pipe 12, which outflow pipe has an outflow pipe section 14 and a mounting base pipe section 16 and is fastened to a mounting base 17 such that it is galvanically isolated from the mounting base 17. The mounting base 17 defines a longitudinal axis of the sanitary fitting 10. The outflow pipe section 14 is freely accessible from the environment and is disposed outside the mounting base 17. The galvanic isolation is realized by means of an electrical first insulation 18. As a result of the galvanic isolation between the outflow pipe 12 and the mounting base 17, the outflow pipe 12 can be used as an electrode of a sensor device 19.

Inside the outflow pipe 12 there is an electrically insulating tube 20 running through the outflow pipe 12, which tube galvanically isolates the water flowing through it from the outflow pipe 12. The electrically insulating tube 20 forms an electrical second insulation 21. The water flowing through the electrically insulating tube 20 passes out of a nozzle element 22 disposed in an outflow-side end section of the outflow pipe 12 through a jet former 23. The electrically insulating tube 20 is connected by its downstream end to the nozzle element 22 and by its upstream end to a screw coupling 24 (see FIG. 2), for example, by means of couplings which are commonly used in sanitary engineering. The screw coupling 24 serves the connection to a valve device 28 disposed beneath a support 26 (see FIG. 2).

The mounting base 17 has a collar-like light-conducting element 30, beneath which there is disposed a mounting base light source 32 which illuminates the collar-like light-conducting element 30. An outlet light source 34 is disposed on the nozzle element 22 of the sanitary fitting 10, the mounting base light source 32 being powered from a first electrical feeder cable 36 and the outlet light source 34 being powered by a second electrical feeder cable 38. The power supply and the controlling of the two light sources 32, 34 is managed by an electronic control system 40. The two feeder cables 36, 38 are connected on the source side to the electronic control system 40 (see FIG. 2). The color of the light is preferably chosen in accordance with the following clarification, in a stand-by state of the sanitary fitting 10, for example, white light or no light being able to be chosen:

blue: the sanitary fitting 10 delivers cold water, orange: the sanitary fitting 10 delivers lukewarm water, red: the sanitary fitting 10 delivers hot water, green: the sanitary fitting 10 is in cleaning mode and can be cleaned without water being delivered when an object approaches.

Beside the outflow pipe section 14 or the mounting base pipe section 16, the sensor device 19 has sensor electronics 42 disposed beneath the support 26, which sensor electronics is electrically connected to the mounting base pipe section 16 or the outflow pipe section 14 by means of a pin 43 likewise belonging to the sensor device 19.

Figure 2:
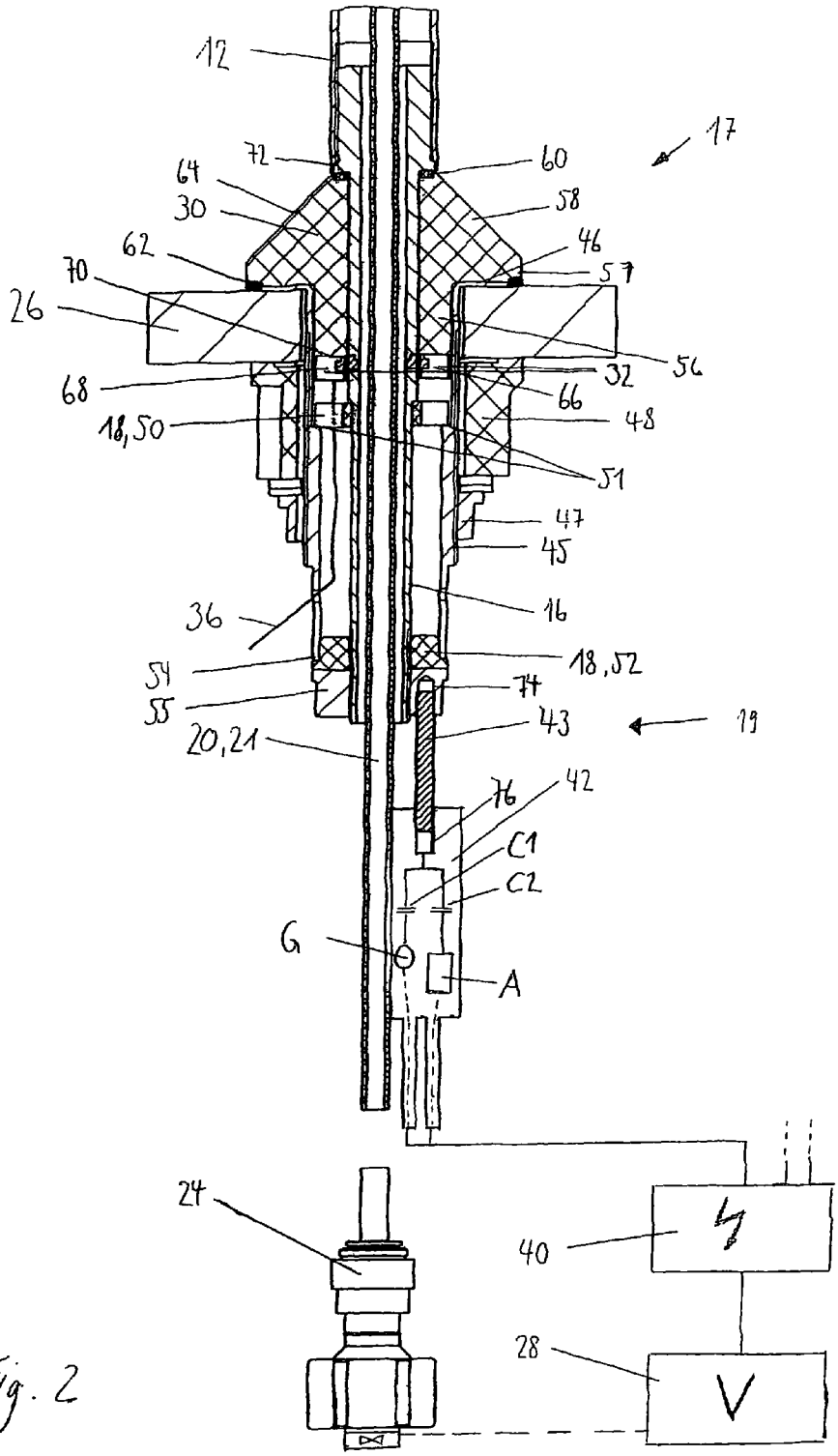
FIG. 2 illustrates, in longitudinal section, and enlarged view with respect to FIG. 1, a part of the sanitary fitting having an electronic control system and a valve device.

FIG. 2 shows a longitudinal section through an enlarged part of the mounting base 17 of the sanitary fitting 10 represented in FIG. 1. The sensor electronics 42 is electrically connected to the electronic control system 40, and this is electrically connected to the valve device 28. The sensor electronics 42 serves to generate a presence or absence signal and to conduct this to the electronic control unit 40, which latter actuates the valve device 28 and the light sources 32, 34. A presence signal is generated when an object, for example a hand, is present within a defined sensor zone 44. An absence signal is generated when no object is present within the defined sensor zone 44. The sensor zone 44 extends around the outflow pipe section 14 at a distance of, for example, about 25 cm.

The mounting base 17 has a mounting base sleeve 45, which reaches through the support 26, for example a wash stand, and at its upper end has a radially outwardly projecting flange 46, which rests against the support 26. The mounting base sleeve 45 is clamped to the support 26 in a known manner by means of a fastening nut 47 screwed onto an external thread present in the lower region of the mounting base sleeve 45 and, where necessary, with the aid of a spacer 48.

The mounting base pipe section 16 reaches through the mounting base sleeve 45 and is mounted within the mounting base sleeve 45 by means of the electrical first insulation 18, which is formed by an electrically insulating conical spring washer 50 and a plug-shaped insulation element 52. Radially on the outside, the electrically insulating conical spring washer 50 rests with a radially outer supporting region 51 against an inner shoulder of the mounting base sleeve 45, and radially on the inside an outer shoulder of the mounting base pipe section 16 is supported by means of the conical spring washer 50. The plug-shaped insulation element 52 has a radially projecting bead, which rests against the inlet-side end 54 of the mounting base sleeve 45. The mounting base pipe section 16 is led through an opening in the plug-shaped insulation element 52. The mounting base pipe section 16 has in its upstream end region an external thread, on which is screwed a retaining nut 55 forming a retaining member, which retaining nut is connected in an electrically conductive manner to the mounting base pipe section 16. With the aid of the conical spring washer 50, the external thread on the mounting base pipe section 16 and the retaining nut 55, which rests on the plug-shaped insulation element 52 and thus pulls the outer shoulder of the mounting base pipe section 16 or the mounting base pipe section 16 downwards, the mounting base pipe section 16 is clamped to the mounting base sleeve 45. The electrically insulating conical spring washer 50 has radially between the mounting base pipe section 16 and the mounting base sleeve 45 openings in the direction of the longitudinal axis, through which the first electrical feeder cable 36 for the mounting base light source 32 is fed.

The collar-like light-conducting element 30, which is disposed on the mounting base 17, has a hollow-cylindrical portion 56, which engages in the mounting base sleeve 45. Above the support 26 and adjoining the flange 46, the light-conducting element 30 has a cylindrical portion 57, which integrally adjoins the hollow-cylindrical portion 56. Above the cylindrical portion 57, the light-conducting element 30 forms, likewise integrally, a truncated cone 58. The outer diameter of the cylindrical portion 57 is larger than the flange 46 of the mounting base sleeve 45. In the direction of the longitudinal axis, the light-conducting element 30 has an opening for the mounting base pipe section 16. The light-conducting element 30 is secured by means of two quad-rings 60, 62, which form sealing elements. The first quad-ring 60 is clamped between the free end of the truncated cone 58 and a circumferential shoulder on the mounting base pipe section 16. The second quad-ring 62 is disposed radially outside the flange 46 of the mounting base sleeve 45, between the cylindrical portion 57 of the light-conducting element 30 and the support 26. The quad-rings 60, 62 prevent too high a tension in the light-conducting element 30 and the penetration of dirt and water. The second quad-ring 62 at the same time compensates for unevennesses on the support 26, in order that a controlled fixing can take place. The light-conducting element 30 is preferably formed from plexiglass or glass.

The mounting base light source 32 is disposed directly beneath the light-conducting element 30, within the mounting base sleeve 45, on the end face and can thus couple light into the light-conducting element 30, which light re-emerges above the support 26 from the light exit area 64 or shell surface of the cylindrical portion 57 and of the truncated cone 58. The mounting base light source 32 has two semi-annular printed circuit boards 66, 68, which in the assembled state form a ring and on whose surface, on the side facing the light-conducting element 30, LEDs are arranged, evenly distributed in the peripheral direction. The mounting base light source 32 feeds in the light via the light entry area 70 at the upstream end of the light-conducting element 30.

The outflow pipe section 14 is screwed with its upstream end region, up to a stop 72 on the mounting base pipe section 16, onto this latter and is thereby connected in an electrically conductive manner thereto.

The electrical connection of the mounting base pipe section 16, and thus of the outflow pipe section 14, to the sensor electronics 42 is established by the pin 43, which engages with an upper end in a blind bore 74 in the retaining nut 55 and with a lower end in a plug socket 76 of the sensor electronics 42. The free face of the pin 43, between the retaining nut 55 and the plug socket 76, is electrically insulated against external influences.

In a preferred manner, the sensor electronics 42 are configured in accordance with the circuitry disclosed in printed publication WO 2004/013966 (FIG. 4B), the outflow pipe section 14 forming a so-called absorption surface. With regard to the structure and working method of the sensor electronics 42, reference is made to printed publication WO 2004/013966. The described sensor electronics 42 generate a presence or absence signal and relay this to the electronic control system 40, which then controls the valve device 28 in accordance with the presence or absence signal, whereby the water flow is started or interrupted. In FIG. 2, an alternating current generator G, a first capacitor C1, a second capacitor C2 and a signal amplifier A are represented. The alternating current generator G generates a signal, which via the capacitor C1 is coupled into the outflow pipe 12 and thus into the outflow pipe section 14. The signal, which has been altered by the presence or absence of an object, for example a hand, is coupled by the capacitor C2 into the signal amplifier A. The signal amplifier A then relays the generated presence or absence signal to the electronic control system 40.

Figure 3:
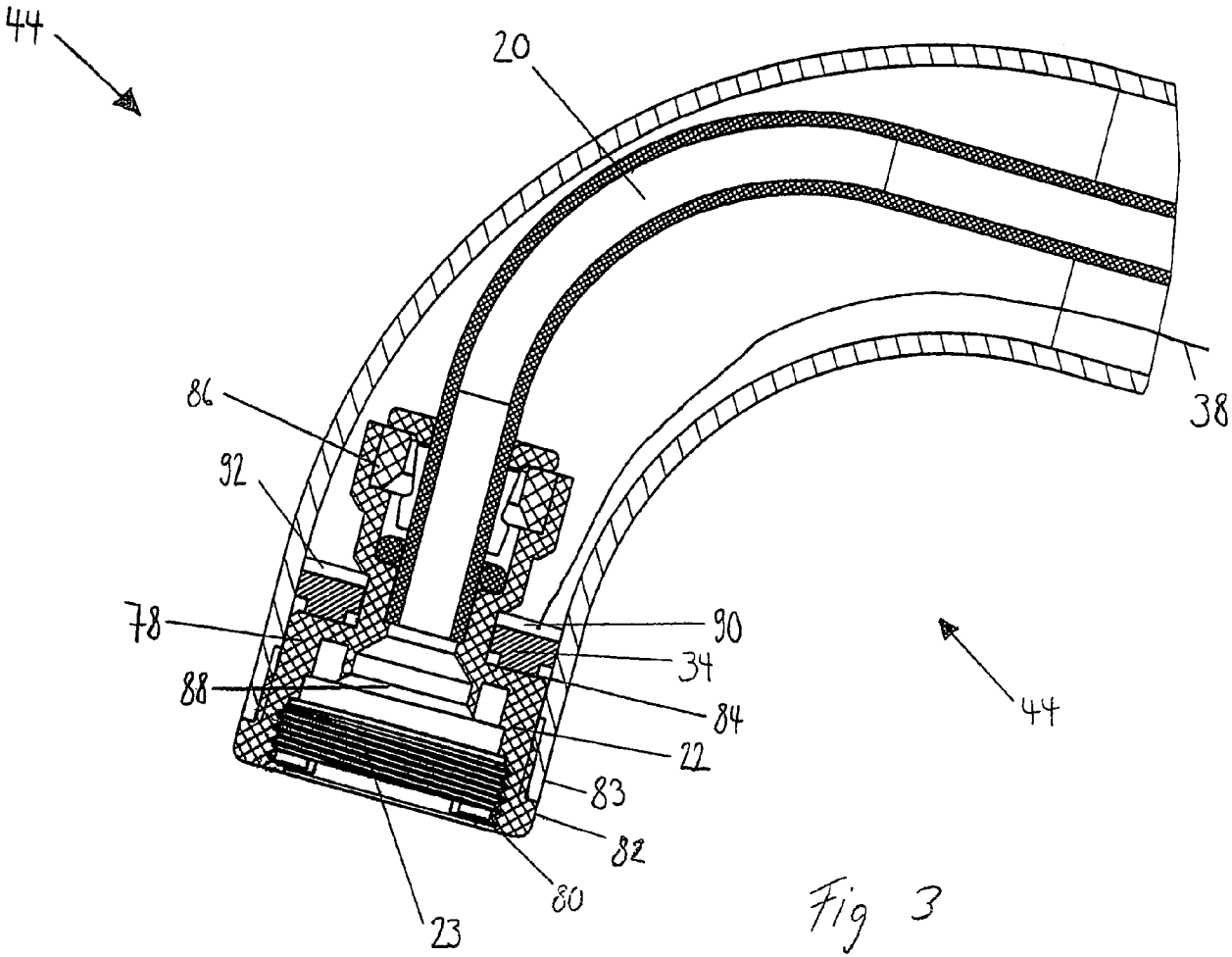
FIG. 3 illustrates, in longitudinal section an outflow-side end section of the outflow pipe, having a light permeable nozzle element which fixes a tube.

FIG. 3 shows a longitudinal section through the outflow-side end section of the outflow pipe 12 of the sanitary fitting 10 represented in FIG. 1. In the outflow-side end section is arranged the nozzle element 22, which has a cup-shaped fastening portion 78 having an internal and an external thread. The external thread serves to screw the nozzle element 22 in place in the outflow-side end section of the outflow pipe 12, which has an internal thread. The internal thread of the nozzle element 22 serves for the fastening of the light-permeable jet former 23 which has a corresponding external thread. The cup-shaped fastening portion 78 of the nozzle element 22 projects in the longitudinal direction of the outflow pipe 12 over the end face thereof, so that a bead forms an end face 80 and a shell surface 82, through which the light stemming from the outflow light source 34 can exit to the environment. The shell surface 82 of the nozzle element 22 lies in the extension of the outer shell surface 83 of the outflow pipe 12. The end face 80 of the nozzle element 22 is preferably oriented at right angles to the shell surface 82 of the nozzle element 22.

The cup-shaped fastening portion 78 has a bottom 84 having a central opening. Protruding from this bottom 84, on the side facing away from jet former 23, is a hollow-cylindrical fixing sleeve 86. The electrically insulating tube 20 is connected up to the protruding, hollow-cylindrical fixing sleeve 86, for example by means of the coupling. The nozzle element 22 is constructed in a light-permeable material, preferably plexiglass, and preferably in one piece.

The second electrical feeder cable 38 for the outlet light source 34 runs through between the tube 20 and the outlet pipe 12 and, in the region of the nozzle element 22, is connected up to the outlet light source 34. The outlet light source 34 is supported on that side of the bottom 84 which is facing away from the fastening portion 78, so that the light is coupled into the nozzle element 22 or the bottom 84. Approximately a first half of the light is coupled through the bottom into a water jet or a water chamber 88 delimited by the fastening portion 78 and the jet former 23. Approximately a second half of the light passes out through the end face 80 and the shell surface 82 of the nozzle element to the environment. The outlet light source 34 has two semi-annular printed circuit boards 90, 92, which in the assembled state form a ring and on whose surface, on the side facing the light-conducting element 30, LEDs are arranged, evenly distributed in the peripheral direction.

The outflow pipe section 14 powered by the alternating current generator G constructs around it an electromagnetic field. If an object, for example a hand, moves or is present in this electromagnetic field or sensor zone 44, then this object influences the electromagnetic field. This is detected by the sensor electronics 42. The valve device 28 and the light sources 32, 34 are then correspondingly actuated and the water and energy flow started. The light serves as an indicator and indicates whether an object is present in the sensor zone 44 and the momentary operating state the sanitary fitting 10.

The sanitary fitting 10 can also be equipped with a one-piece outflow pipe 12, which is formed from an electrically conductive material.

It is also possible to provide the outflow pipe 12 with an internally fitted electrical insulation, which would be used in place of the tube 20. In this case, the upstream connecting region of the outflow pipe 12 must be galvanically isolated from the valve device 28, preferably at the upstream end of the outflow pipe 12.

The outflow pipe section 14 can also be mounted on the mounting base pipe section 16 rotatably with respect to the longitudinal axis. If the outflow pipe 12 is configured in one piece, then it is conceivable to mount the outflow pipe 12 on the electrical first insulation 18 rotatably with respect to the longitudinal axis. In both cases, the outflow pipe section 14 or the outflow pipe 12 must be formed from electrically conductive material.

In districts with very clean drinking water, an insulation situated inside the outflow pipe 12 can be dispensed with, since very clean drinking water is a poor electrical conductor.

The outflow pipe section 14 can also be electrically insulated against the mounting base pipe section 16, in which case an electrical conductor must lead from the sensor electronics 42 to the outflow section 14.

The nozzle element 22 can also be formed from a light-impermeable material, for example steel. In this case, an electrical insulation must be arranged between the nozzle element 22 and the outflow pipe section 14 in order to isolate the water flowing through the sanitary fitting 10 galvanically from the outflow pipe section 14.

It will be appreciated that the various of the above-disclosed and other features and functions, or alternatives thereof, may be desirably combined into many other different devices or applications. Also, various presently unforeseen or unanticipated alternatives, modifications, variations or improvements therein may be subsequently made by those skilled in the art which are also intended to be encompassed by the following claims.

What is claimed is:

1. A sanitary fitting comprising:

a mounting base; and an outflow pipe disposed on the mounting base, the outflow pipe having:

an outflow pipe section running outside the mounting base, the outflow pipe section being electrically conductive and being galvanically isolated from the mounting base, and a sensor device for detecting a presence or absence of a person in a sensor zone having sensor electronics electrically connected to the outflow pipe section, the outflow pipe section forming an electrode of the sensor device, and an electrical first insulation being arranged between the mounting base and an electrically conductive mounting base pipe section in order to isolate the outflow pipe galvanically from the mounting base, wherein:

the outflow pipe has the electrically conductive mounting base pipe section and the outflow pipe section arranged thereon, the electrically conductive mounting base pipe section runs through the mounting base, the first insulation including:

a first insulation element, or a conical spring washer, arranged such that the mounting base pipe section reaches through the first insulation element, and a radially outer supporting region of the first insulation element rests against the mounting base or a mounting base sleeve, and provides support for the mounting base pipe section, and a second insulation element disposed between the mounting base, or the mounting base sleeve, and the mounting base pipe section, and either (1) the second insulation element rests against an inlet-side end of the mounting base or the mounting base sleeve, or (2) a retaining nut disposed on the mounting base pipe section rests against the second insulation element.

2. The sanitary fitting according to claim 1, wherein at least the outflow pipe section is also galvanically isolated from water that flows through the outflow pipe and the outflow pipe section.

3. The sanitary fitting according to claim 1, further comprising:

an electronic control system; and a valve device, controlled by the electronic control system, to control water flow through the outflow pipe.

4. The sanitary fitting according to claim 3, wherein control electronics are connected to the electronic control system in order to deliver presence and absence signals thereto.

5. The sanitary fitting according to claim 1, wherein on the inner side of the outflow pipe there is a second electrical insulation for separating the outflow pipe galvanically from water.

6. The sanitary fitting according to claim 5, wherein the second electrical insulation has an electrically insulating tube running through the outflow pipe, and water flows through the electrically insulating tube.

7. The sanitary fitting according to claim 6, wherein the electrically insulating tube is connected on an outlet side to a nozzle element disposed on the outflow pipe or the outflow pipe section, the nozzle element is made of electrically insulating material, and additional electrical insulation is present between the nozzle element and the outflow pipe.

8. The sanitary fitting according to claim 7, further comprising an outlet light source assigned to the nozzle element, which illuminates the water jet leaving the nozzle element and/or couples light into the nozzle element made of light-conducting material, which light passes out of the nozzle element at a free end face and/or shell surface thereof.

9. The sanitary fitting according to claim 8, wherein an electrical feeder line for the outlet light source runs between the outflow pipe and the electrically insulating tube.

10. The sanitary fitting according to claim 1, wherein the mounting base has a light conducting element running, in the manner of a collar, around the outflow pipe or the mounting base pipe section and the light-conducting element has a light entry area inside the mounting base and a light exit area free to the environment, such that on the mounting base, a mounting base light source emitting light to the light entry area is arranged, and light passes out through the light exit area into the environment.

* * * * *